US005144995A

United States Patent [19]

Pettersson

[11] Patent Number: 5,144,995

[45] Date of Patent: Sep. 8, 1992

[54] APPARATUS FOR SPLITTING LOOSE OBJECTS SUCH AS TREE TRUNKS

[76] Inventor: Bo Pettersson, Lillebo Gingri, S-513 00 Fristad, Sweden

[21] Appl. No.: 685,220

[22] Filed: Apr. 12, 1991

[51] Int. Cl.[5] ..... B27L 7/00

[52] U.S. Cl. ..... 144/366; 144/193 R; 144/193 D; 144/193 F

[58] Field of Search ..... 144/3 K, 193 R, 193 A, 144/193 D, 193 F, 366

[56] References Cited

U.S. PATENT DOCUMENTS

| | | | |
|---|---|---|---|
| 3,461,927 | 8/1969 | Funari | 144/193 R |
| 3,834,436 | 9/1974 | Burkett | 144/366 |
| 4,559,985 | 12/1985 | May | 144/366 |
| 4,615,367 | 10/1986 | Crowley, Jr. | 144/366 |

*Primary Examiner*—W. Donald Bray
*Attorney, Agent, or Firm*—Dvorak and Traub

[57] ABSTRACT

Apparatus for splitting tree trunks by forcing a splitting element into the tree trunk while manipulating the tree trunk. The tree trunk is manipulated by a grab to abut against support and to be cleft by a vehicle-mounted splitting element which is movable when actuated by a vehicle.

9 Claims, 6 Drawing Sheets

APPARATUS FOR SPLITTING LOOSE OBJECTS SUCH AS TREE TRUNKS

The subject invention concerns a method of splitting loose objects, such as wood or timber, in the form of e.g. large tree trunks and the like by constrained displacement of a vehicle-mounted, movable splitting and cleaving means towards a backup support during the splitting operation, and by handling the object by means of a grab.

One problem encountered in reducing logs and other timber into chips is that a chipper can be used only with logs of comparatively small dimensions. In order to solve this problem logs having dimensions exceeding the capacity of the chipper have hitherto conventionally been split with the aid of wedges which are driven manually into the log to split the latter into smaller units that may be handled by the chipper. Also other solutions have been suggested, such as the use of a table on which the objects to be cut are deposited prior to being operated on by means of power-driven wedge-shaped splitting members.

These solutions are, however, poorly adapted for mechanised and efficient application at the site of deposition of said objects and the principal purpose of the subject invention is to solve this problem.

This purpose is achieved in accordance with the method of the invention which is essentially characterized by the steps of positioning one end of the object in abutment against preferably a rock, wall or other suitable backup support readily accessible and pressing said end against said support during the splitting operation while the object is lying on the ground, and by moving the splitting element along the object by driving the vehicle with the splitting element mounted thereon towards and along the object.

A further object of the subject invention is to provide a device that may be used in connection with the performance of the method.

Said further object is achieved by means of a device in accordance with the subject invention which is essentially characterized therein that a splitting element in the form of a blade presenting a cutting edge at its front is arranged to be supported by an utility vehicle, preferably a tractor with the cutting blade extending in the intended plane of splitting and vehicle-driving direction in order to displace the splitting element longitudinally relatively to the associated object. A grab, supported by a telescopically extensible supporting arm mounted on the tractor, is used to position the log.

One preferred embodiment of the invention will be described in the following with reference to the accompanying drawings, wherein.

Figure 1:
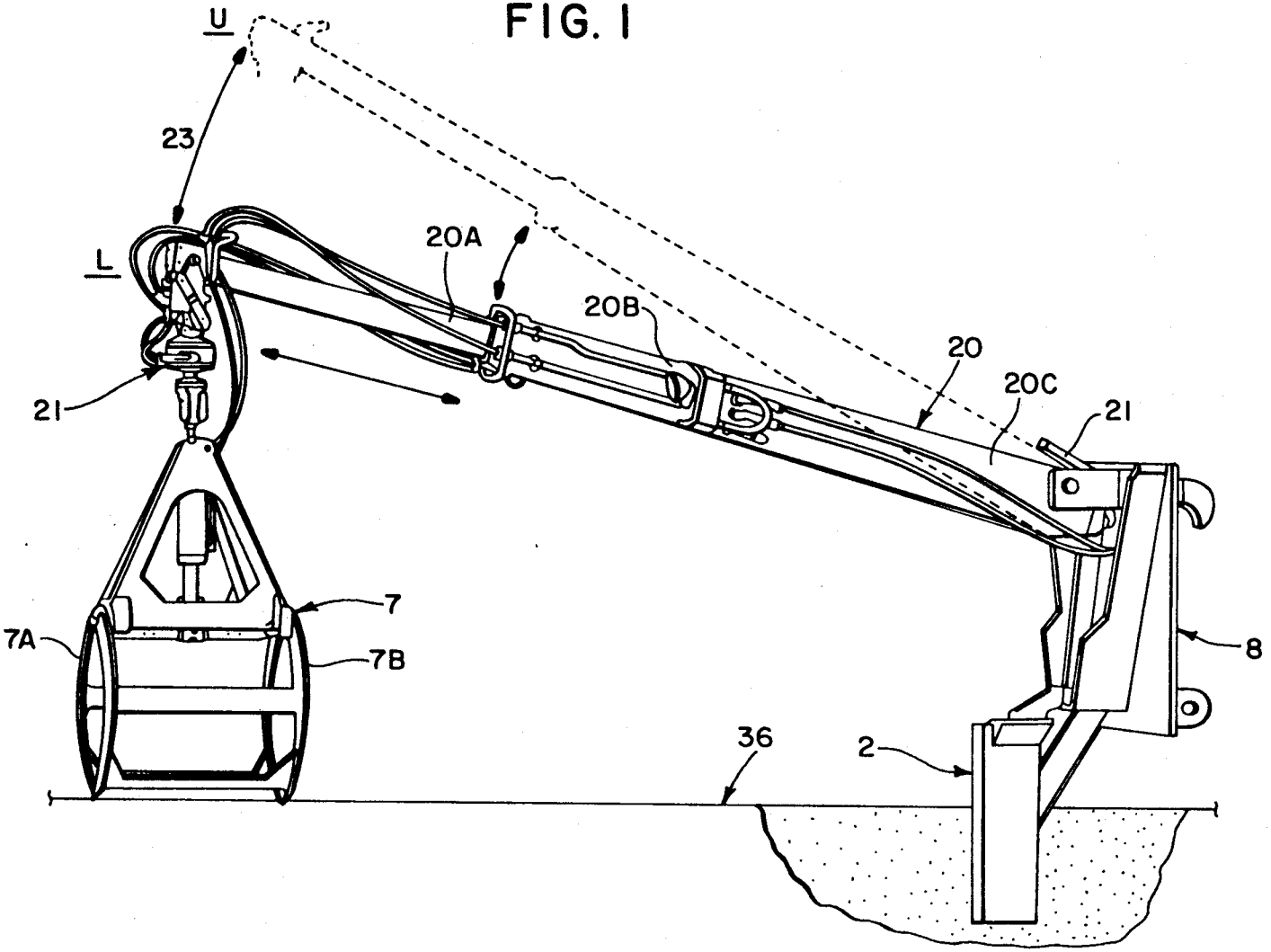
FIG. 1 illustrates a splitting unit in accordance with the invention when in disconnected position.
Figure 2:
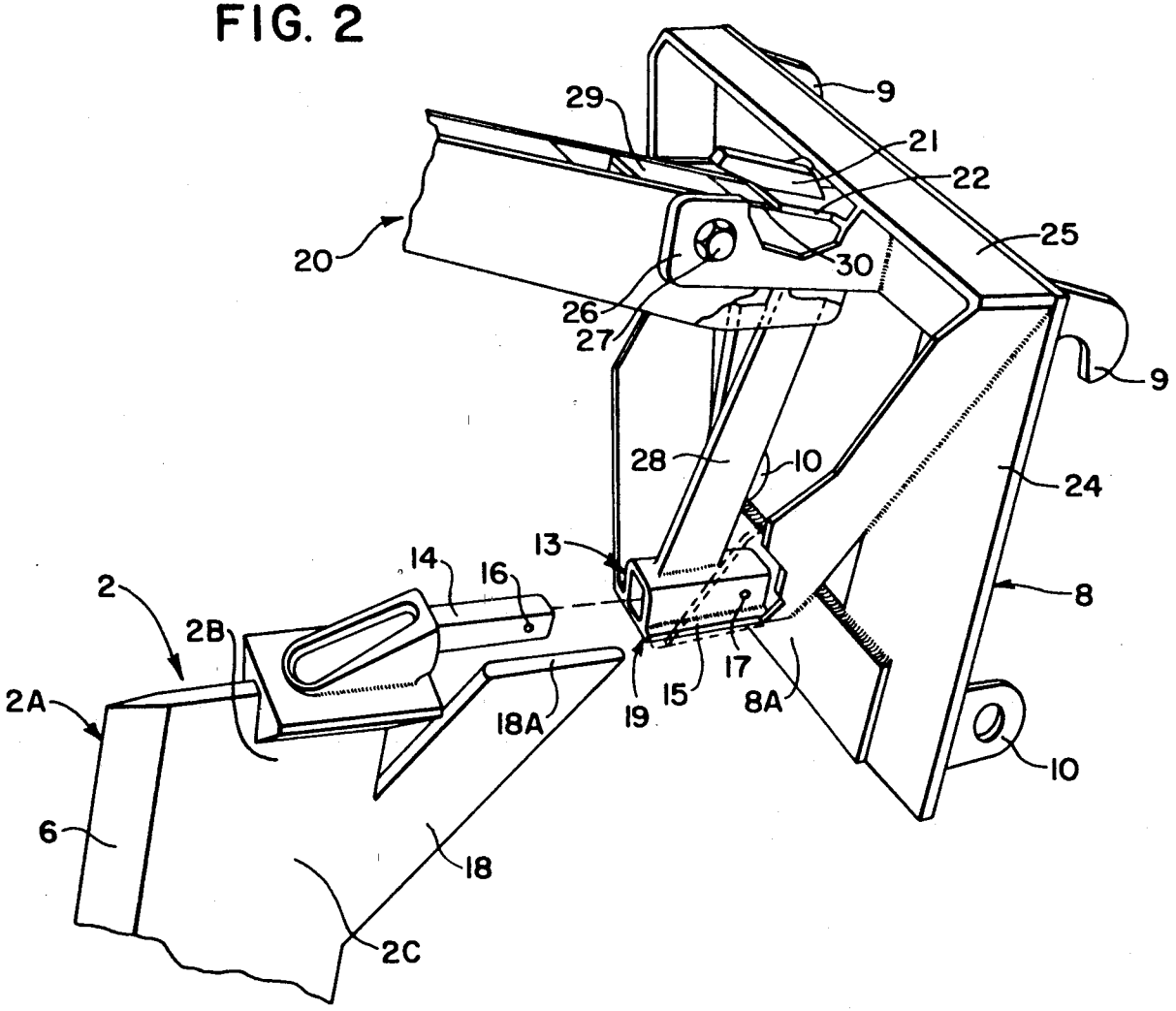
FIG. 2 illustrates a detail component of the unit in position ready for connection.
Figure 3:
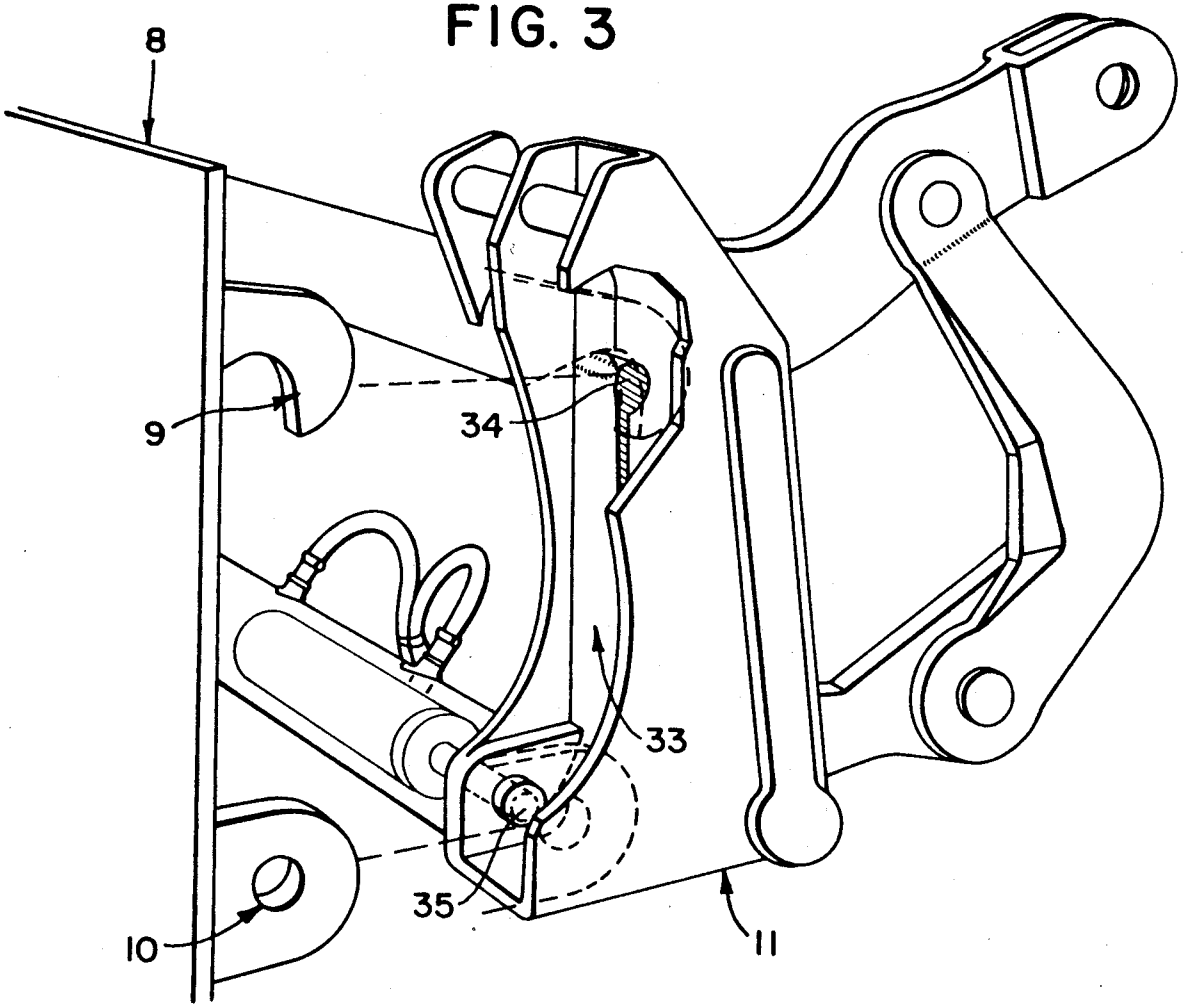
FIG. 3 illustrates a coupling means in a vehicle for interconnection with a unit.
Figure 4:
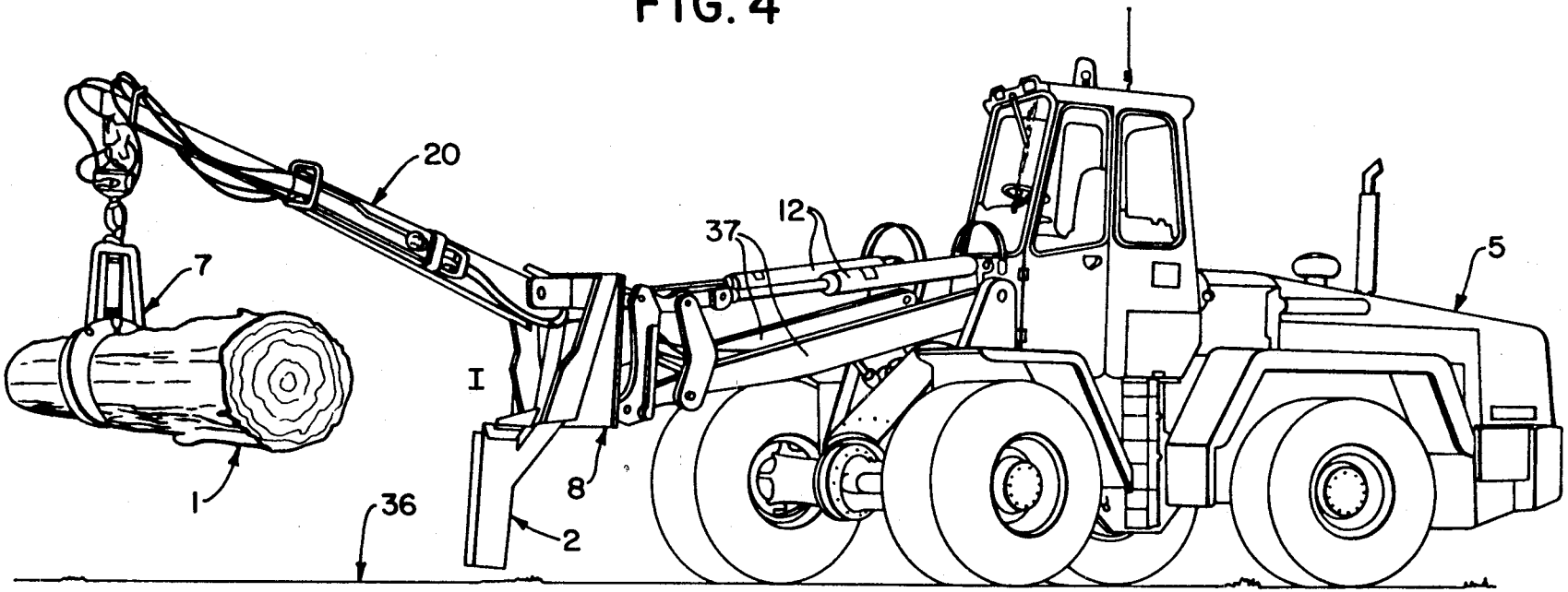
FIG. 4 is a perspective view of a centrally articulated front loader equipped with a splitting unit and a grab during an orientation phase.
Figure 5:
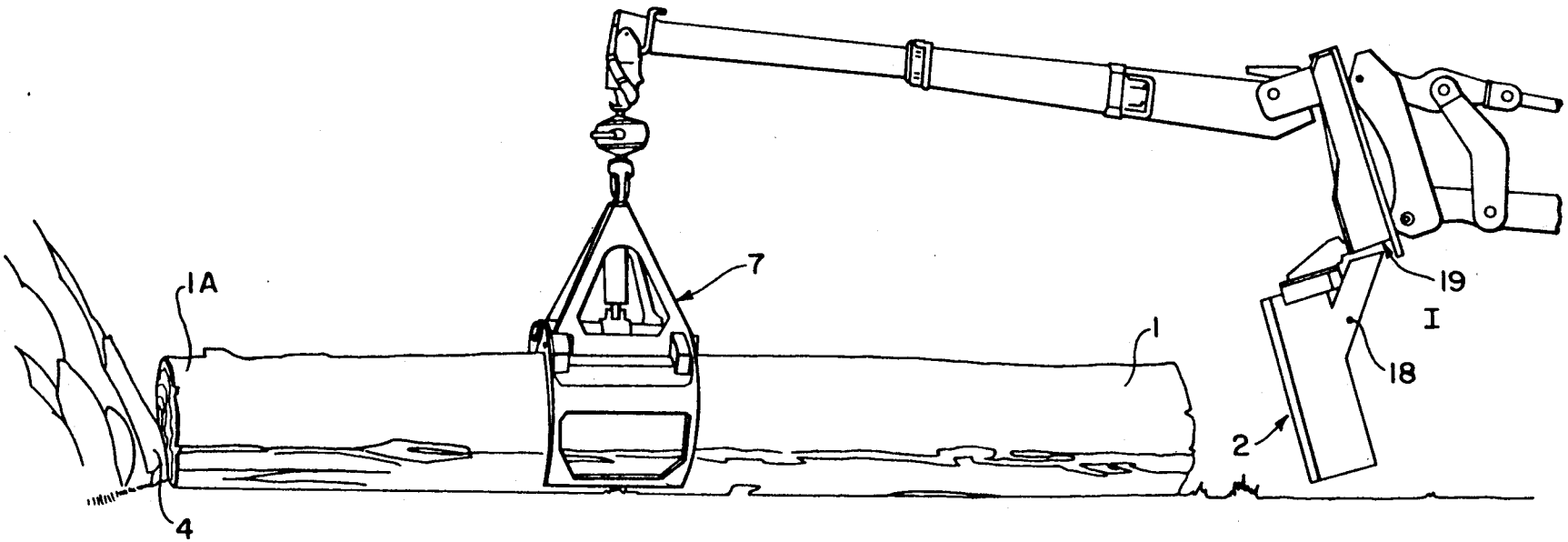
FIG. 5 illustrates the device during the log deposition phase prior to splitting.
Figure 6:
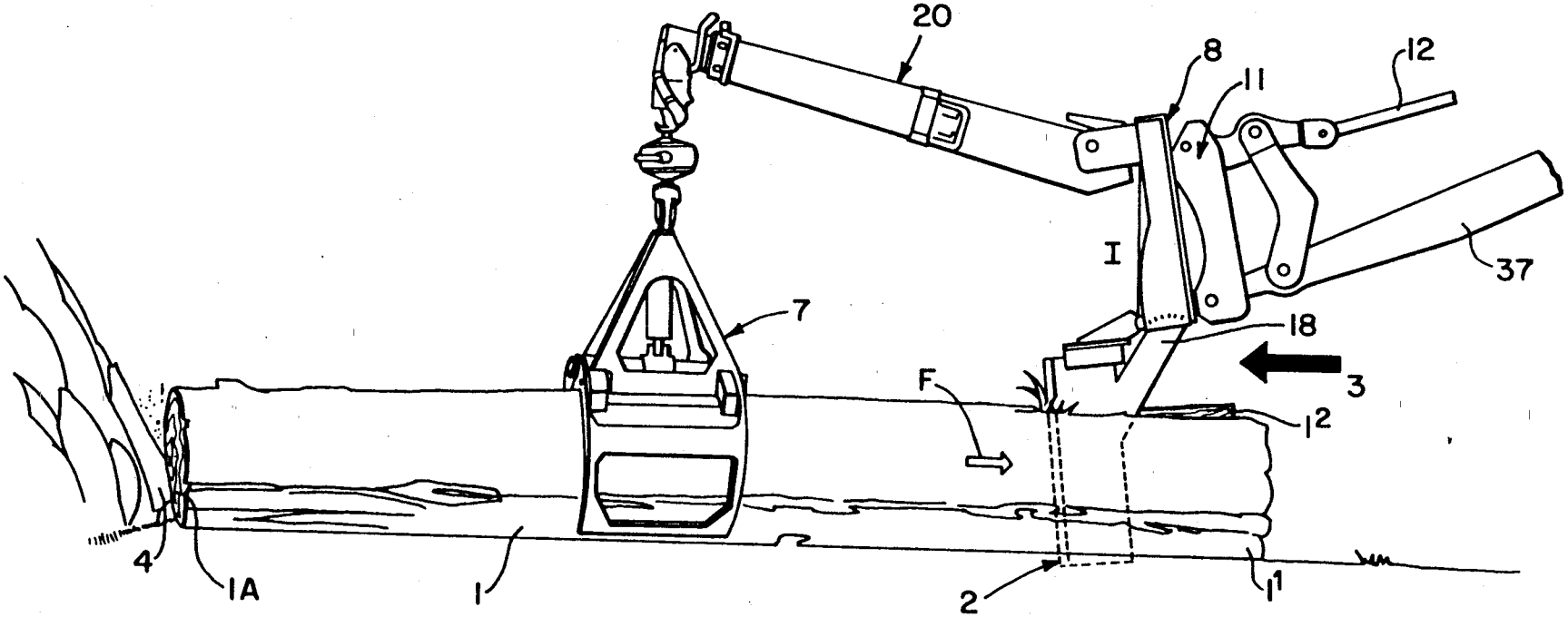
FIG. 6 illustrates the device during the splitting phase.

The invention is primarily adapted to be used in connection with splitting logs 1 which have been cut into shorter lengths from large-dimension tree trunks but which invention could be used also to split other timber or loose objects, if desired.

The splitting into two pieces of the loose object 1 is effected by forcing a vehicle-mounted severing means 2 to move relatively to the object 1, more by moving the splitting element 2, in the direction indicated by arrow 3 along the object 1 while simultaneously cooperating with the object so as to split the latter in two. For the purpose of preventing the object 1 from altering its position during the splitting operation, the object 1 is deposited in a manner ensuring that one 1A of its ends, abuts against a backup face or support 4, for instance in the form of a rock or a wall or other readily accessible backup. The object is pressed against backup under the influence of the splitting element 2 as it is displaced by the vehicle, while simultaneously cleaving the object 1.

In order to achieve the movability referred to, the splitting element 2 is arranged to be supported by a utility vehicle 5, preferably a centrally articulated front loader or similar tractor. The splitting element 2 is in the shape of a blade having a wedge-like wood-engageable cutting edge 6 at its front 2A, the blade extending in the intended plane of splitting. In accordance with the embodiment illustrated, the splitting element 2 extends along an essentially vertical plane but it could also have a different support, such as for instance a horizontal one or a combination of crossing cutting edges.

Preferably, the splitting element 2 is supported, together with a grab 7 arranged to grip and handle the object 1 in question, by means of a unit 8 formed with coupling members 9, 10, whereby the unit 8 may be releasably connected to a grab attachment 11 of the vehicle 5. In the interconnected position of the device with the vehicle 5, the element 2 together with the grab 7, if used, are arranged in such a manner that they may be actuated and controlled with the aid of pistons or other power means 12 provided on the vehicle 5.

The splitting element 2 is additionally formed with means allowing it to be releasably interconnected with the unit 8. Such means could include e.g. a bar 14 arranged for reception in a cavity 13. In accordance with the embodiment illustrated, the bar 14 projects rearwardly towards the unit 8 and is attached to the upper end 2B of the splitting element 2 for insertion into a sleeve 15 projecting centrally from the lower end 8A of the unit in a forward direction. When required, the bar 14 may be secured in the internal cavity 13 of the sleeve 15, e.g. by means of a locking pin which is introduced manually through apertures 16, 17 formed in respectively the bar 14 and the sleeve 15.

A support 18 which is integral with the splitting element 2 and which, in accordance with the embodiment illustrated, consists of a thrust rod projecting in a direction obliquely rearwards from the rear upper part 2C of the splitting element 2 towards the unit 8. By abutting against and resting on a bearing portion 19 at the lower part of the unit, preferably the lower face of the attachment sleeve 15, the support 18 is arranged to cooperate with the unit 8 for the purpose of preventing transfer of excess moment forces from the splitting element 2 to the unit 8 via the coupling means 13–15.

The grab 7 may be in the form of two gripping arms 7A and 7B actuated either hydraulically or by some other pressure fluid. A swivel 21 or other suitable rotary joint that is mounted for rotary movement about the outer section 20A of a number of arm sections 20A, 20B, together forming a telescopically adjustable pivotal arm 20, supports the grab 7 in such a manner that the latter may be pivoted to the desired position.

The pivot arm 20 of the grab 7 is arranged to be actuated by abutment means 21, 22 which limit the angular movement of the arm 20 in the vertical direction of pivotment 23, between a lower position L and an upper position U.

The unit 8 may be formed by a centrally open main frame 24 on a rear face 24A of which the coupling members 9 and 10 are provided, preferably positioned at the corners of the unit, and presenting on its front face a preferably triangular attachment frame 25. An attachment means 26, which supports the gripping arm 20 for pivotable movement about a pivot shaft 27, is formed at the upper part of the attachment frame and the main frame whereas coupling members 13, 15 pertaining to the splitting element 2 are supported at the lower parts of said frames. A stay 28 extends between said attachment 26 and the coupling members 13, 15.

The abutments means 21, 22 which may be in the form of a plate having a protruding portion, are supported by said attachment means 26 and are arranged in such a manner that they may cooperate with counter-abutment means 29, 30, formed respectively by a portion bridging the side walls 31, 32 of the arm and by the upper rear portion of the arm side walls.

The coupling members 9, 10 of the unit 8 preferably are of the conventional kind used for releasable attachment to vehicles of other implements, such as buckets. The upper, hook-shaped coupling members 9 are arranged to be received in a protecting coupling-receiving space 33 and be hooked onto a gripping portion 34 of matching configuration and the lower, lug-shaped coupling members 10 are likewise arranged to be received in the coupling-receiving space 33 and be locked in position, for instance with the aid of a movable locking pin 35 which forms part of a hydraulically operated piston- and cylinder unit and which, in its extended position, is received in the coupling member 10 and locks the latter in position, together with the rest of the unit 8.

When not supported by a vehicle 5 the unit 8 may be deposited on a bedding 36 with the splitting element 2 preferably inserted into the bedding. In order to facilitate the insertion without damaging the unit 8 and also to avoid that the embedding force will have to be unnecessarily large, the bedding could consist of e.g. saw dust or other soft material.

The splitting element 2 thus may be displaced longitudinally relatively to the object 1 by driving the vehicle 5 which supports the splitting element 2 towards and along the object 1 while at the same time the object 1 is being cleft lengthwise. During this operation, one end 1A of the object will cooperate with an abutment or backup member 4 in the surroundings. Preferably, the grab 7 is allowed to let go of the object 1 during the splitting thereof but alternatively, as illustrated in the drawings, the length of the gripping arm 20 may be altered as the splitting progresses. During the splitting phase the upper abutment part 18A of the support 18 will rest against the attachment sleeve 15 or other backup means connected with the frame 8 in order to distribute the force F acting on the splitting element 2 onto the frame 8. When the vehicle 5 has been driven sufficiently far for the splitting element 2 to assume a position close to the forwards end 1A of the object, the splitting of the latter is completed and the various pieces $1^1$, $1^2$ thereof may be run through a chipper without any difficulty.

The splitting element 2 and the grab 7 could be controlled and actuated from the vehicle by means of the existing lifting arms 37, power means 12 and grab attachment 11.

The invention is not limited to the embodiments illustrated in the drawings and described in the aforegoing but a number of modifications are possible within the scope of the invention without departing from the invention idea.

I claim:

1. Apparatus for splitting large tree trunks and the like by forcing a vehicle-mounted, movable splitting element to move towards a backup support, and by positioning the tree trunk with a grab for splitting, characterized by a splitting element having a splitting edge, a grab adapted for grasping and positioning said tree trunk, a telescopically extensible arm for supporting said grab in front of said splitting edge, a support unit adapted to be mounted on a vehicle, a support portion of said support unit pivotally supporting on an end of said arm, the other end of said arm pivotally supporting said grab, the lower portion of said support unit supporting said splitting element, said unit being releasably connectable to the grab attachment of a preferably centrally articulated front loader so as to be controlled and actuated by means of existing power means of the vehicle.

2. Apparatus as claimed in claim 1, characterized by a means on said splitting element, such as a bar receivable in a cavity for releasably coupling said splitting element to said unit.

3. Apparatus as claimed in claim 2, characterized by a support which is integrally connected with the splitting element and projects therefrom in the direction towards said unit when said element and said unit are interconnected, said support arranged to abut and bear against a bearing portion formed at the lower part of said unit.

4. Apparatus as claimed in claim 1, characterized in that the grab which preferably is arranged for rotary movement relatively to the support arm, is arranged to be actuated by abutment means limiting the angular movement of said arm in the vertical direction of pivotment.

5. Apparatus as claimed in claim 1, characterized in that said grab which is preferably arranged for rotary movement relatively to said support arm, is arranged to be actuated by abutment means limiting the angular movement of said arm in the vertical direction of pivotment.

6. Apparatus as claimed in claim 2, characterized in that said grab which is preferably arranged for rotary movement relatively to said support arm, is arranged to be actuated by abutment means limiting the angular movement of said arm in the vertical direction of pivotment.

7. Apparatus as claimed in claim 3, charaterized in that said grab which is preferably arranged for rotary movement relatively to said support arm, is arranged to be actuated by abutment means limiting the angular movement of said arm in the vertical direction of pivotment.

8. A method of splitting loose objects, such as large tree trunks, comprising the steps of grabbing a tree trunk, moving the tree trunk, telescopically extensibly supported, and positioning it on the ground with one end of the tree trunk against a backup support, pressing a splitting element releasably mounted on a vehicle, against the other end of said tree trunk, and continuing the pressing in a longitudinal direction of said tree trunk until said tree trunk is split.

9. A method as claimed in claim 8, characterized in that a member which is connected to said splitting element is arranged to abut against a portion of said unit in order to increase the cleaving capacity of the splitting element in the intended position.

* * * * *